US009631873B2

(12) United States Patent
Daly et al.

(10) Patent No.: US 9,631,873 B2
(45) Date of Patent: Apr. 25, 2017

(54) PROCESS FOR TRANSFERRING HEAT OR MODIFYING A TUBE IN A HEAT EXCHANGER

(71) Applicant: UOP LLC, Des Plaines, IL (US)

(72) Inventors: Phillip F. Daly, Palatine, IL (US); Kenneth D. Peters, Elmhurst, IL (US)

(73) Assignee: UOP LLC, Des Plaines, IL (US)

( * ) Notice: Subject to any disclaimer, the term of this patent is extended or adjusted under 35 U.S.C. 154(b) by 98 days.

(21) Appl. No.: 14/037,486

(22) Filed: Sep. 26, 2013

(65) Prior Publication Data

US 2014/0020875 A1 Jan. 23, 2014

Related U.S. Application Data

(63) Continuation of application No. 12/965,817, filed on Dec. 10, 2010, now Pat. No. 8,613,308.

(51) Int. Cl.

| | |
|---|---|
| ***F28D 7/02*** | (2006.01) |
| ***B21C 37/20*** | (2006.01) |
| ***F28F 1/40*** | (2006.01) |
| ***F28F 1/42*** | (2006.01) |
| ***F28F 9/22*** | (2006.01) |
| ***F28D 7/16*** | (2006.01) |
| *F28F 1/00* | (2006.01) |
| *F28D 21/00* | (2006.01) |

(52) U.S. Cl.
CPC ..... *F28D 7/02* (2013.01); *B21C 37/207* (2013.01); *F28D 7/1607* (2013.01); *F28F 1/40* (2013.01); *F28F 1/422* (2013.01); *F28F 9/22* (2013.01); *F28D 2021/0059* (2013.01); *F28F 1/006* (2013.01); *Y10T 29/49391* (2015.01)

(58) Field of Classification Search
CPC ..... F28D 7/02
See application file for complete search history.

(56) References Cited

U.S. PATENT DOCUMENTS

| | | | | |
|---|---|---|---|---|
| 3,559,437 | A * | 2/1971 | Withers | 72/96 |
| 3,847,212 | A * | 11/1974 | Withers et al. | 165/179 |
| 4,364,820 | A * | 12/1982 | DeGraff et al. | 208/101 |
| 5,091,075 | A * | 2/1992 | O'Neill et al. | 208/134 |
| 6,827,138 | B1 * | 12/2004 | Master et al. | 165/159 |

* cited by examiner

*Primary Examiner* — Randy Boyer

(57) ABSTRACT

One exemplary embodiment can be a process for transferring heat to a first stream from a second stream in a hydrocarbon process. The process can include passing the first stream through at least one generally vertically-orientated tube in an exchanger. An interior surface of the at least one generally vertically-orientated tube may form one or more curved irregularities where the first stream, prior to entering the at least one generally vertically-orientated tube, may include a mixture of a gas including hydrogen and at least one or more C1-C3 hydrocarbons, and a liquid including one or more C4-C13 hydrocarbons.

3 Claims, 3 Drawing Sheets

PROCESS FOR TRANSFERRING HEAT OR MODIFYING A TUBE IN A HEAT EXCHANGER

CROSS-REFERENCE TO RELATED APPLICATION

This application is a Continuation of Application No. 12/965,817 now U.S. Pat. No. 8,613,308, filed Dec. 10, 2010, the contents of which are hereby incorporated by reference in its entirety.

FIELD OF THE INVENTION

This invention generally relates to a process for transferring heat or for modifying a tube in a heat exchanger.

DESCRIPTION OF THE RELATED ART

Vertically-oriented heat exchangers can be used in many processes, including hydrocarbon processes. Often, a vertically-oriented exchanger may be used to preheat a mixed phase of a liquid hydrocarbon feed and a gas rich in hydrogen. Typically, a vertically-oriented exchanger is used as a combined feed and effluent (hereinafter may be abbreviated "CFE") exchanger where a mixed phase of a hydrocarbon liquid and a gas are preheated with the effluent from a reactor. Increasing the performance of the CFE exchanger may have an important impact on the energy usage of the process unit. Particularly, additional heat recovered from the CFE exchanger can reduce the energy required for a charge heater and the reactor products condenser. Moreover, the tube side performance of the CFE exchanger may often limit the size and overall performance of the exchanger, particularly for catalytic reforming units.

Often, a liquid hydrocarbon feed and a gas, often a recycle gas including hydrogen, are mixed and introduced on the tube side. Generally, the mixture requires good lift to pass upwards through the vertically-oriented heat exchanger. However, achieving proper lift in the tubes can be difficult due to low inlet temperatures and low recycle gas flow. As a result, the number of tubes may be limited for use, thereby limiting the size and performance of CFE exchanger. Generally, poor liquid lift is typically due to low velocities at the tube inlet resulting in poor liquid-vapor distribution in the tubes, poor heat transfer, and increased tube side fouling. As a result, the liquid lift constraints can impact the overall performance of the CFE exchanger because tube lengths are often limited to no more than about 24 meters due to fabrication shop and tube availability limitations. What is more, the tube side heat transfer coefficient can often be the primary factor in the heat transfer performance of the CFE exchanger. These heat transfer deficiencies of the CFE exchanger can restrict charge through the unit.

As a consequence, there is a desire to improve the heat transfer characteristics of new or existing vertically-oriented heat exchangers utilized in hydrocarbon processing.

SUMMARY OF THE INVENTION

One exemplary embodiment can be a process for transferring heat to a first stream from a second stream in a hydrocarbon process. The process can include passing the first stream through at least one generally vertically-orientated tube in an exchanger. An interior surface of the at least one generally vertically-orientated tube may form one or more curved irregularities where the first stream, prior to entering the at least one generally vertically-orientated tube, may include a mixture of a gas including hydrogen and at least one or more C1-C3 hydrocarbons, and a liquid including one or more C4-C13 hydrocarbons.

Another exemplary embodiment may be a process for modifying a tube for a generally vertically-orientated exchanger in a hydrocarbon unit. The process can include introducing an insert into the tube where the insert may form one or more curved irregularities for modifying an interior of the tube.

A further exemplary embodiment can be a process for transferring heat from an effluent to a first stream in a reforming process. The process can include passing the first stream through at least one generally vertically-orientated tube in an exchanger. Generally, an interior surface of the tube can form one or more curved irregularities and the first stream, prior to entering the at least one generally vertically-orientated tube, may include a mixture of a gas including at least about 60%, by volume, hydrogen and a liquid including one or more C4-C12 hydrocarbons.

The embodiments disclosed herein can provide a tube for a vertically-oriented heat exchanger that has one or more curved irregularities within the tube. Particularly, the tube can form helical grooves and/or ridges that increase the heat transfer from a fluid inside the tube to a fluid in a shell of an exchanger by improving the liquid lift and the liquid-vapor distribution of the tubes. Moreover, the tube can also form or contain external fins to increase heat transfer. Additionally, an existing tube can be retrofitted to receive an insert having one or more curved irregularities formed therein. Thus, the liquid lift and liquid-vapor distribution of the tubes may be improved, and the heat transfer of an existing heat exchanger can be increased.

DEFINITIONS

As used herein, the term "stream" can include various hydrocarbon molecules, such as straight-chain, branched, or cyclic alkanes, alkenes, alkadienes, and alkynes, and optionally other substances, such as gases, e.g., hydrogen, or impurities, such as heavy metals, and sulfur and nitrogen compounds. The stream can also include aromatic and non-aromatic hydrocarbons. Moreover, the hydrocarbon molecules may be abbreviated C1, C2, C3 . . . Cn where "n" represents the number of carbon atoms in the one or more hydrocarbon molecules.

As used herein, the term "substantially" can mean at least generally about 90%, preferably about 99%.

As used herein, the term "rich" can mean an amount of at least generally about 50%, and preferably about 70%, by mole, of a compound or class of compounds in a stream.

As used herein, the term "vapor" can mean a gas or a dispersion that may include or consist of one or more hydrocarbons.

DETAILED DESCRIPTION

Figure 1:
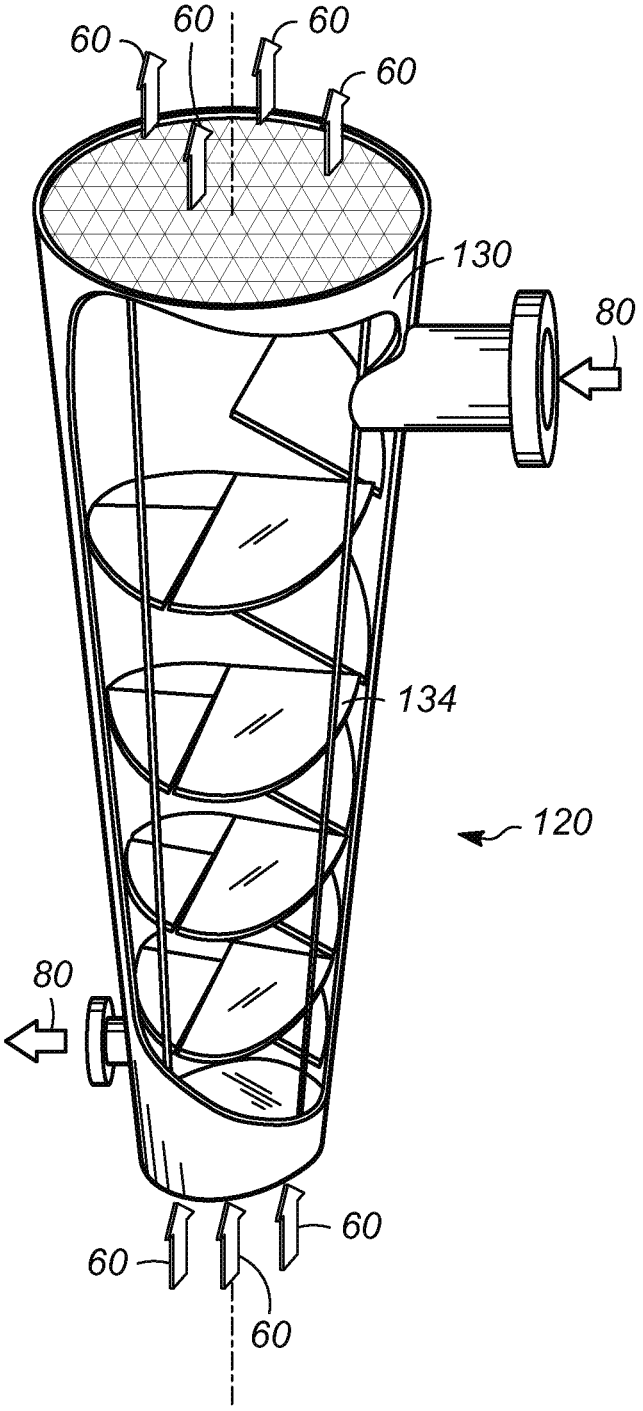
FIG. 1 is an elevational, cut-away view of an exemplary shell of a heat exchanger.
Figure 2:
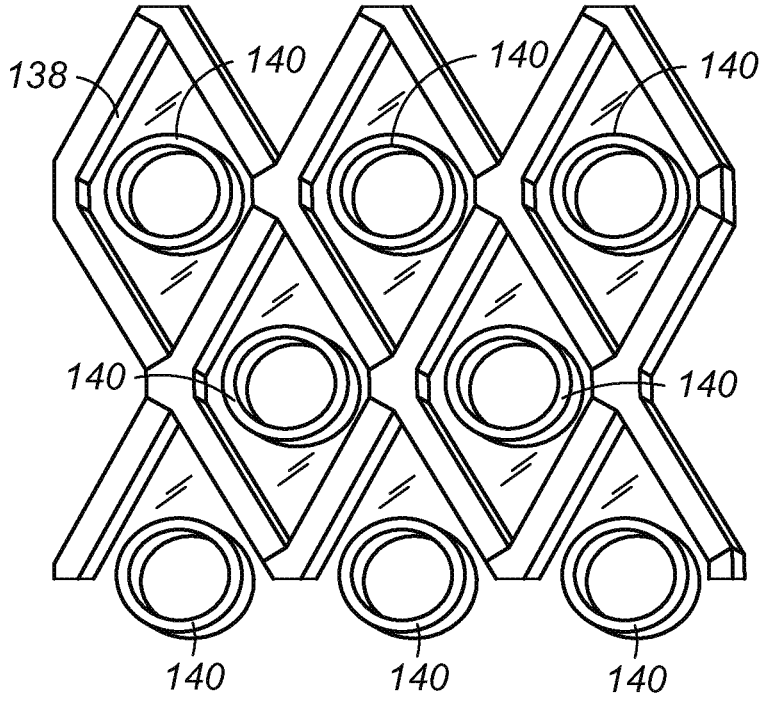
FIG. 2 is a horizontal, plan view of a portion of an exemplary expanded metal baffle of a heat exchanger.

Referring to FIGS. 1-2, exemplary shells for a vertically-oriented heat exchanger are at least partially depicted. Particularly, referring to FIG. 1, an exchanger 120 can form a shell 130 with a helical baffle 134. Particularly, a first stream 60, which is typically a mixed phase stream including a liquid hydrocarbon and a gas, typically hydrogen, can be provided to a bottom of the exchanger and passed through tubes (not shown) and exit at a top end. Conversely, a second stream 80, often an effluent from a reaction zone, can enter a top of the exchanger, pass through the helical baffles 134 and exit near the bottom. Such a shell containing helical baffles is disclosed, in, e.g. U.S. Pat. No. 6,827,138 B1. An alternative shell structure, namely an internal structure, of a heat exchanger is partially depicted in FIG. 2. In this exemplary shell, tubes 140 are positioned within an expanded metal baffle 138. Such a shell is disclosed in, e.g. U.S. Pat. No. 7,610,953 B2. However, it should be understood that the tubes as disclosed herein can be utilized in any suitable exchanger having any suitable baffle type. Typically, the exchanger is oriented at any suitable angle of generally about 0 - about 45° from vertical, usually substantially vertical.

Figure 3:
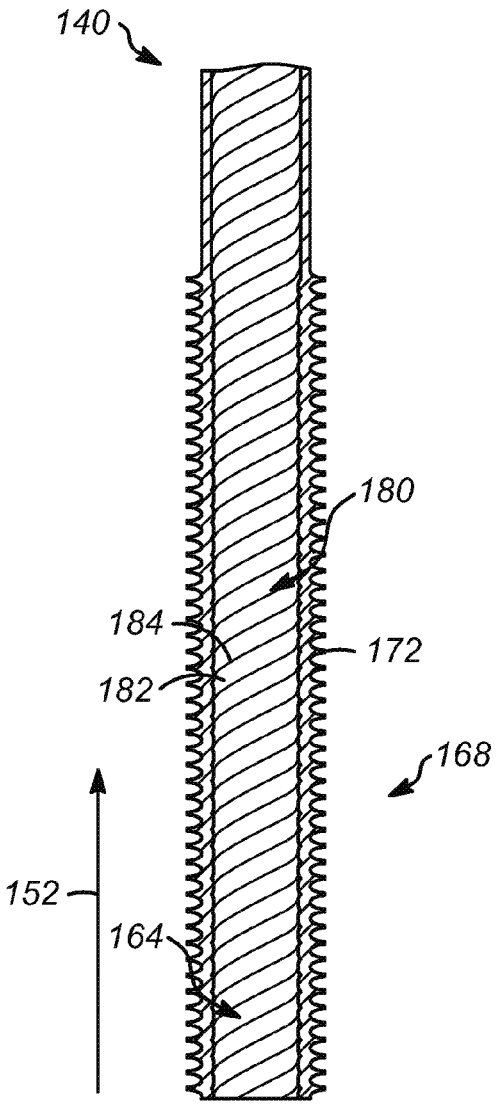
FIG. 3 is a cross-sectional view of a portion of an exemplary tube.

Referring to FIG. 3, a portion of one of the exemplary tubes 140 is depicted. Generally, the tube 140 within the exchanger is orientated substantially vertically 152. Usually, the tube 140 can be oriented at an angle of about 0 - about 45°, preferably orientated at an angle of no more than about 10° from vertical.

Typically, the tube 140 can have an interior 164 and an exterior 168. Generally, one or more fins 172 can be formed on the exterior 168 while one or more curved irregularities 180 can be formed on the interior 164. Generally, the curved irregularities can be formed by any suitable process, such as grinding, rolling, or extruding. As a result, one or more grooves 182 may be formed between one or more ridges 184 forming a helical pattern, although any suitable pattern may be formed. Although the one or more curved irregularities 180 can be one or more grooves 182 or one or more ridges 184, preferably a combination of such structures are formed. Procedures for making grooves and/or ridges inside a tube are disclosed in, e.g., U.S. Pat. Nos. 2,181,927, 3,559,437, 3,847,212, and US 2005/0145377 A1. Thus an exchanger can contain any number of tubes 140 to facilitate heat transfer.

The length of the one or more curved irregularities 180 can extend about 5 - about 40% of the total tube length, with about 10 - about 30% being preferred to minimize additional pressure drop while providing desired liquid-vapor distribution, improved vertical flow regime, and improved heat transfer in a two-phase region. The one or more curved irregularities 180 can be formed near the inlet of a feed stream having a mixed phase, or encompass the entire length of the tube. However, often the one or more curved irregularities 180 only extend a portion of the tube 140 because inserts would be retrofitted into the tubes of an existing exchanger. The one or more curved irregularities 180 may only extend a portion of the length of the tube to minimize unnecessary pressure drop.

Figure 4:
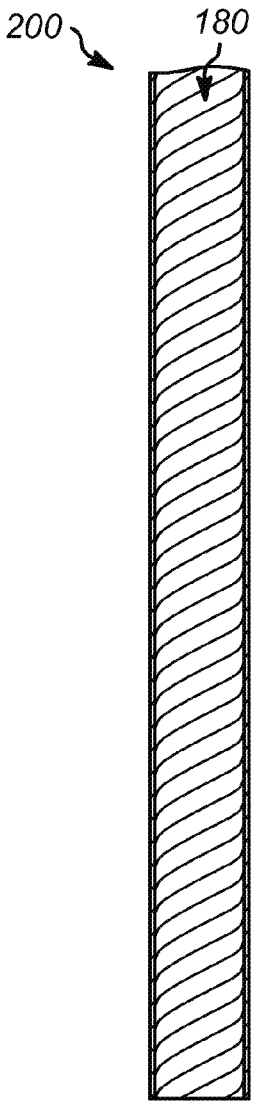
FIG. 4 is cross-sectional view of a portion of an exemplary insert for a tube.

Referring to FIG. 4, a portion of an insert 200 is depicted. The insert 200 can include one or more curved irregularities 180 as discussed above, but can omit the one or more fins 172 that can be used to additionally enhance heat transfer. Generally, the insert 200 can be positioned into an existing tube, and thus may have a slightly smaller outside diameter than an inside diameter of an existing tube. Typically, the insert 200 may be of any suitable length, such as a part or the entire length of the tube. By sliding the insert within a tube, an existing heat exchanger tube can be modified to provide enhanced heat transfer.

As discussed, the exemplary tubes utilized in an exchanger can be utilized in any desirable service for processing hydrocarbons. Particularly, the hydrocarbon processes can include reforming naphtha, isomerizing xylene, converting aromatics, and dehydrogenating paraffins. Such processes are discussed in, e.g., Dachos et al., *UOP Platforming Process,* Chapter 4.1, Handbook of Petroleum Refining Processes, editor Robert A. Meyers, 2nd edition, pp. 4.1-4.26 (1997), and Silady, *UOP Isomer Process*, Chapter 2.5, Negiz et al., *UOP Tatoray Process*, Chapter 2.7, and Pujadó, *UOP Pacol Dehydrogenation Process*, Chapter 5.2, Handbook of Petroleum Refining Processes, editor, Robert A. Myers, 3rd edition, pp. 2.39-2.46, 2.55-2.63, and 5.11-5.19 (2004).

Usually, the one or more liquid hydrocarbons provided to the exchanger are combined with a gas that may include make-up and/or recycle gas. Any suitable hydrocarbons, such as hydrotreated naphtha, one or more xylenes, toluene and benzene, and/or paraffins, may be provided to the exchanger. Generally, these hydrocarbons can include one or more C4-C13 hydrocarbons. Any suitable gas, including one or more C1-C6, preferably C1-C3, hydrocarbons as well as hydrogen, may be combined with the liquid hydrocarbons to form a mixed-phased feed of one or more liquids and gases. Hydrogen comprised in the feed can be generally at least about 30%, preferably at least about 40%, and optimally at least about 60%, by mole, based on the total moles of liquids and gases in the feed. After mixing the liquids and gases prior to entering the tubes, the feed may pass upward therein. On the shell side of the exchanger, any suitable reactor effluent can be utilized including one or more C1-C13 hydrocarbons and hydrogen. Often, the reactor effluent can include one or more paraffins, xylenes, toluene, benzene, and olefins. Generally, the maximum pressure drop from an inlet to an outlet of a tube may be about 41 - about 83 kPa and the feed side pressure drop may preferably be about 27 - about 56 kPa. Typical parameters for several exemplary processes are depicted in Table 1 below:

TABLE 1

| Unit | Reforming | Isomerizing | Converting | Dehydrogenating |
|---|---|---|---|---|
| Feed | hydrotreated naphtha; C5-C12, normally C6-C11 hydrocarbons | mostly xylenes; C6-C8 hydrocarbons | mostly toluene and benzene | paraffins; C10-C13 hydrocarbons |
| Gas | C1-C6 hydrocarbons and about 70 - about 80%, $H_2$, by volume | C1-C3 hydrocarbons and about 80-about 90%, $H_2$, by volume | C1-C4 hydrocarbons and about 70-about 80%, $H_2$, by volume | C1-C4 hydrocarbons and at least about 90% $H_2$, by volume |

TABLE 1-continued

| Unit | Reforming | Isomerizing | Converting | Dehydrogenating |
|---|---|---|---|---|
| Reactor Effluent | C1-C11 hydrocarbons and $H_2$ | mostly xylenes; C1-C3, and C6-C8 hydrocarbons, $H_2$ | toluene, benzene, xylene; C1-C4 hydrocarbons, and $H_2$ | C1-C4 and C10-C13 hydrocarbons, and $H_2$ |
| Maximum pressure (kPa)/ typical feed side pressure drop (kPa) in tubes with curved irregularities | about 76/about 34-about 49 | about 83/about 41-about 56 | about 79/about 34-about 49 | about 41/about 27-about 34 kPa |

Utilizing the one or more curved irregularities can improve the flow characteristics at the inlet on the tube side of the exchanger. Thus, the heat transfer coefficient can be improved along at least a part of the length of the tube. Generally, the one or more curved irregularities on the inside surface of the tubes can induce swirling to avoid a plug-flow regime, improve liquid-vapor distribution, improve lift, and thus enhance heat transfer. In addition, the one or more tubes may include one or more fins to improve heat transfer on the outside of the tubes.

Generally, the embodiments disclosed herein allow for the use of additional tubes with corresponding lower velocities in the heat exchanger compared to designs without one or more irregularities while maintaining acceptable lift characteristics for the liquid portion of the fluid traveling upwards in the tube. The tubes can be used in combination with tubes not forming one or more curved irregularities on their inside surface. So a combination of grooved and ungrooved tubes may be used.

In addition, there can be a synergy between modifications to the tube and the shell for increasing the heat transfer characteristics of the exchanger because the shell-side-improvements would no longer be limited by the heat transfer deficiencies of the tubes. The exemplary shells with baffles disclosed above, as well as others, may be utilized.

Thus, the improved heat transfer can improve unit operations. By improving the two-phase vertical flow regime, the lift of the liquid portion of the fluid can be improved and thus can lower flow requirements of the recycle gas. Moreover, such improvements can allow an increased charge of feeds through the unit.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for modifying a tube for a generally vertically-orientated exchanger in a hydrocarbon unit, comprising retrofitting an insert into the tube wherein the insert forms one or more curved irregularities for modifying an interior of the tube.

2. The process according to claim 1, wherein the one or more curved irregularities forms one or more helical grooves.

3. The process according to claim 1, wherein the one or more curved irregularities comprises one or more ridges.

* * * * *